US009969064B2

(12) United States Patent
Huang

(10) Patent No.: US 9,969,064 B2
(45) Date of Patent: May 15, 2018

(54) RATCHET TOOL WITH STACKED SWITCHING DEVICE

(71) Applicant: INFAR INDUSTRIAL CO., LTD., Chang-Hwa (TW)

(72) Inventor: Hsien-Min Huang, Chang-Hwa (TW)

(73) Assignee: Infar Industrial Co., Ltd., Chang-Hwa (TW)

( * ) Notice: Subject to any disclaimer, the term of this patent is extended or adjusted under 35 U.S.C. 154(b) by 277 days.

(21) Appl. No.: 15/089,102

(22) Filed: Apr. 1, 2016

(65) Prior Publication Data

US 2016/0354903 A1 Dec. 8, 2016

(30) Foreign Application Priority Data

Jun. 3, 2015 (TW) ..... 104117940 A

(51) Int. Cl.
*B25B 13/46* (2006.01)

(52) U.S. Cl.
CPC ..... *B25B 13/463* (2013.01)

(58) Field of Classification Search
CPC ..... B25B 13/463; B25B 15/04; B25B 13/465; B25B 13/468; B25B 13/461
See application file for complete search history.

(56) References Cited

U.S. PATENT DOCUMENTS 5,782,147 A * 7/1998 Chaconas ..... B25B 13/463 192/43.1
5,983,757 A * 11/1999 Blise ..... B23K 1/0008 81/57.39
6,070,499 A * 6/2000 Wisbey ..... B25B 13/467 81/57.29
7,299,720 B1 * 11/2007 Schultz ..... B25B 13/463 81/62
9,815,179 B2 * 11/2017 Anderson ..... B25B 13/463

* cited by examiner

*Primary Examiner* — Robert Scruggs
(74) *Attorney, Agent, or Firm* — Wang Law Firm, Inc.

(57) ABSTRACT

A ratchet tool with stacked switching device includes a handle, two stacked engaging assemblies, two springs, a toothed wheel, and a control unit. Each of the engaging assemblies includes stacked first and second engaging members. The engaging portions of the first and second engaging members are staggered. Since the toothed wheel selectively engages with the engaging portions of the first and second engaging members, the number of teeth of the toothed wheel to be engaged with the two engaging assemblies is the sum of the number of teeth of the engaging portions of the first and second engaging members, thus enhancing the fineness of the rotation of the toothed wheel, and improving the easiness and applicability of the ratchet tool, without impacting the structural strength.

10 Claims, 5 Drawing Sheets

RATCHET TOOL WITH STACKED SWITCHING DEVICE

CROSS REFERENCE TO RELATED APPLICATION

This application claims the benefit of priority to TW 104117940, filed on Jun. 3, 2015 with the Intellectual Property Office of the Republic of China, Taiwan, the entire specification of which is incorporated herein by reference.

BACKGROUND

Field of the Invention

The present invention relates to a ratchet tool, and more particularly to a ratchet tool with stacked switching device.

Related Prior Art

Ratchet hand tools are one of the most convenient daily used tools due to the fact that the features of one-way rotation and reverse idle rotation allow for quick rotation of a fastener in a restricted space without requiring repeated engagement and disengagement of the fastener.

However, the angle of the reverse idle rotation of a ratchet hand tool is decided by the tooted wheel and the paw elastically engaged with the toothed wheel. When micro angle rotation is required, normally it has to reduce the size of the toothed wheel and the teeth of the paw, reducing the pitch of teeth can make the teeth engagement more precise. The toothed wheel is the structure which will be subjected to a force during operation. When the size of the teeth of the toothed wheel is reduced, the structure strength of the teeth is also reduced, which will reduce the life of the toothed wheel or the paw.

SUMMARY

The present invention is aimed at providing a ratchet tool with stacked switching device which has arisen to mitigate and/or obviate the afore-described disadvantages.

Therefore, a ratchet tool with stacked switching device in accordance with one aspect of the present invention, comprises:

a handle with a head portion and a handle portion extending from the head portion, the head portion including a working hole, a device cavity which communicates with the working hole, and a lateral cavity which communicates with the device cavity;

two stacked engaging assemblies each including a first engaging member and a second engaging member, the first and second engaging members each including an engaging portion at one side thereof, the engaging portions each including a plurality of teeth with a pitch, one surface of the first engaging member being provided with a driven portion, one surface of the second engaging member being provided with an inserting portion, another surface of the second engaging member being provided with a drive portion, wherein the first and second engaging members are stacked upon each other, the inserting portion fits in the driven portion, the engaging portions are staggered by a half of the pitch, the two stacked engaging assemblies are disposed at two ends of the device cavity;

two springs disposed between the two stacked engaging assemblies, and located between the two first engaging members, and between the two second engaging members, respectively;

a toothed wheel rotatably disposed in the working hole to selectively engage with the engaging portions of the first or second engaging member; and a switch member including a control cavity formed on one surface thereof, the control cavity being defined by a terminal surface and two lateral surfaces which each have one end connected to two ends of the terminal surface, a positioning angle being defined at each of the connections between the lateral surfaces and the terminal surface, the control cavity including an engaging mouth formed between another ends of the two lateral surfaces, wherein a distance between another ends of the two lateral surfaces is smaller than a length of the terminal surface, the switch member is rotatably disposed on the handle and partially inserts in the lateral cavity, the engaging mouth of the control cavity is located toward the two stacked engaging assemblies, and the drive portion is disposed in the control cavity.

A ratchet tool with stacked switching device in accordance with another aspect of the present invention, comprises:

a handle with a head portion and a handle portion extending from the head portion, the head portion including a working hole, a device cavity which communicates with the working hole, and a lateral cavity which communicates with the device cavity;

two stacked engaging assemblies each including a first engaging member and a second engaging member, the first and second engaging members each including an engaging portion at one side thereof, the engaging portions each including a plurality of teeth with a pitch, one surface of the first engaging member being provided with a driven portion, one surface of the second engaging member being provided with an inserting portion, another surface of the second engaging member being provided with a drive portion, wherein the driven portion is a circular cavity, the inserting portion is a circular protrusion, the first and second engaging members are stacked upon each other, the inserting portion fits in the driven portion, the engaging portions are staggered by a half of the pitch, the two stacked engaging assemblies are disposed at two ends of the device cavity;

two springs disposed between the two stacked engaging assemblies, and located between the two first engaging members, and between the two second engaging members, respectively;

a toothed wheel rotatably disposed in the working hole to selectively engage with the engaging portions of the first or second engaging member; and a switch member including a control cavity formed on one surface thereof, the control cavity being defined by a terminal surface and two lateral surfaces which each have one end connected to two ends of the terminal surface, a positioning angle being defined at each of the connections between the lateral surfaces and the terminal surface, the control cavity including an engaging mouth formed between another ends of the two lateral surfaces, wherein a distance between another ends of the two lateral surfaces is smaller than a length of the terminal surface, the switch member is rotatably disposed on the handle and partially inserts in the lateral cavity, the engaging mouth of the control cavity is located toward the two stacked engaging assemblies, and the drive portion is disposed in the control cavity.

A ratchet tool with stacked switching device in accordance with another aspect of the present invention, comprises:

a handle with a head portion and a handle portion extending from the head portion, the head portion including a working hole, a device cavity which communicates with the working hole, and a lateral cavity which communicates with the device cavity;

two stacked engaging assemblies each including a first engaging member and a second engaging member, the first and second engaging members each including an engaging portion at one side thereof, the engaging portions each including a plurality of teeth with a pitch, one surface of the first engaging member being provided with a driven portion, one surface of the second engaging member being provided with an inserting portion, another surface of the second engaging member being provided with a drive portion, wherein the driven portion is a circular protrusion, the inserting portion is a circular cavity, the first and second engaging members are stacked upon each other, the inserting portion fits in the driven portion, the engaging portions are staggered by a half of the pitch, the two stacked engaging assemblies are disposed at two ends of the device cavity;

two springs disposed between the two stacked engaging assemblies, and located between the two first engaging members, and between the two second engaging members, respectively;

a toothed wheel rotatably disposed in the working hole to selectively engage with the engaging portions of the first or second engaging member; and a switch member including a control cavity formed on one surface thereof, the control cavity being defined by a terminal surface and two lateral surfaces which each have one end connected to two ends of the terminal surface, a positioning angle being defined at each of the connections between the lateral surfaces and the terminal surface, the control cavity including an engaging mouth formed between another ends of the two lateral surfaces, wherein a distance between another ends of the two lateral surfaces is smaller than a length of the terminal surface, the switch member is rotatably disposed on the handle and partially inserts in the lateral cavity, the engaging mouth of the control cavity is located toward the two stacked engaging assemblies, and the drive portion is disposed in the control cavity.

The ratchet tool with stacked switching device in accordance with the present invention enables the toothed wheel to selectively engage with one of the two engaging assemblies, each of the engaging assemblies includes the stacked first and second engaging members, and the engaging portions of the first and second engaging members are staggered. Since the toothed wheel can be selectively engaged with the engaging portions of the first and second engaging members, which means that the number of teeth of the toothed wheel to be engaged with the two engaging assemblies is the sum of the number of teeth of the engaging portions of the first and second engaging members, thus enhancing the fineness of the rotation of the toothed wheel, and improving the easiness and applicability of the ratchet tool, without impacting the structural strength.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

DETAILED DESCRIPTION

The present invention will be clearer from the following description when viewed together with the accompanying drawings, which show, for purpose of illustrations only, the preferred embodiment in accordance with the present invention.

Figure 1:
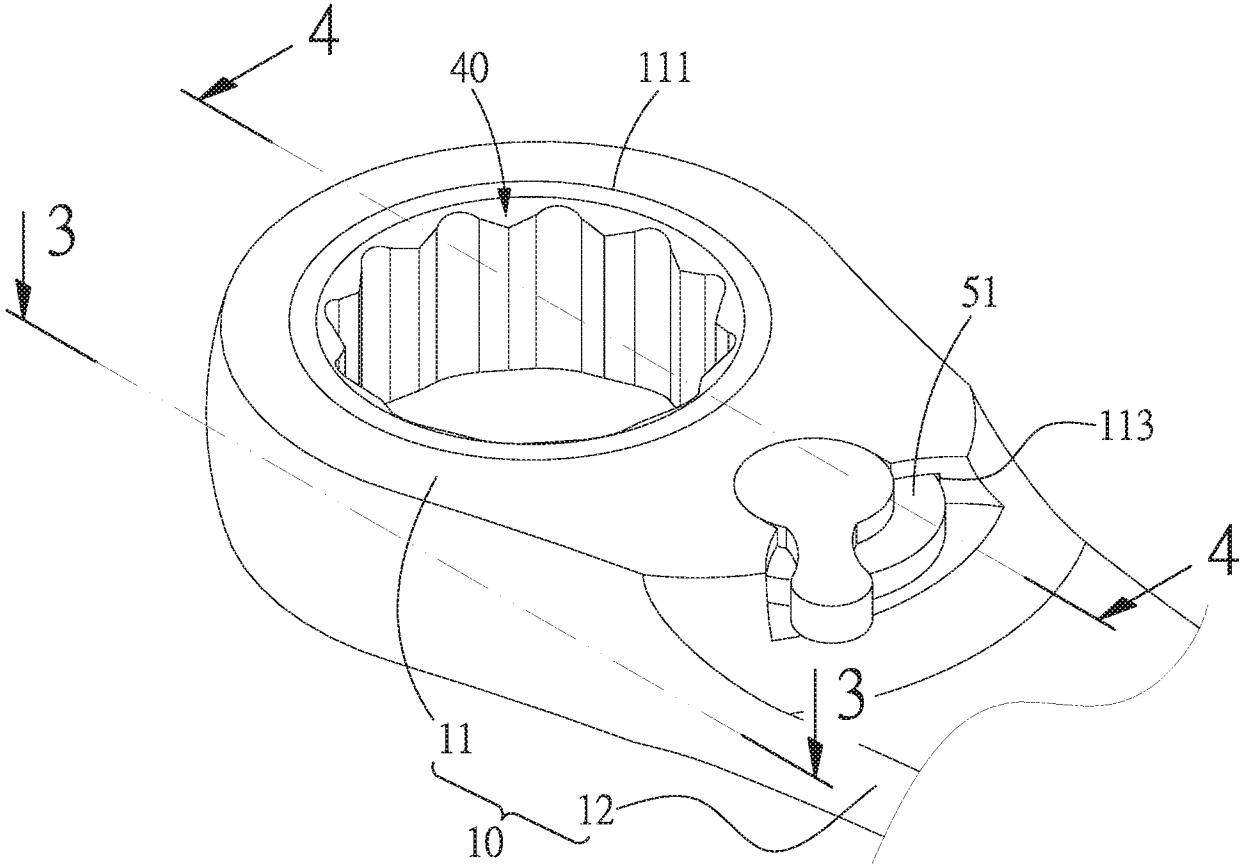
FIG. 1 shows a ratchet tool with stacked switching device in accordance with the preferred embodiment of the present invention.
Figure 2:
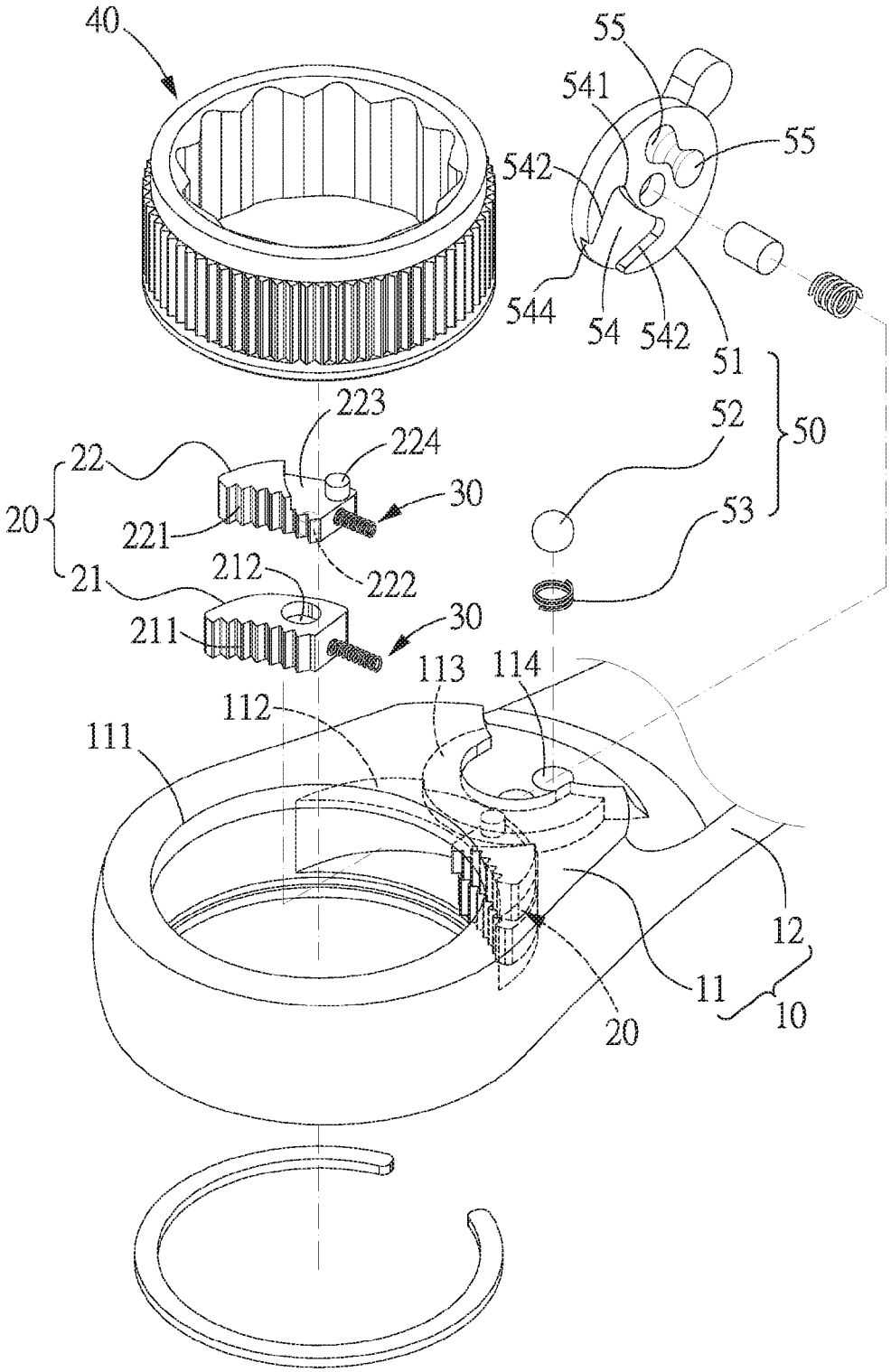
FIG. 2 is an exploded view of the ratchet tool with stacked switching device in accordance with the preferred embodiment of the present invention.
Figure 3:
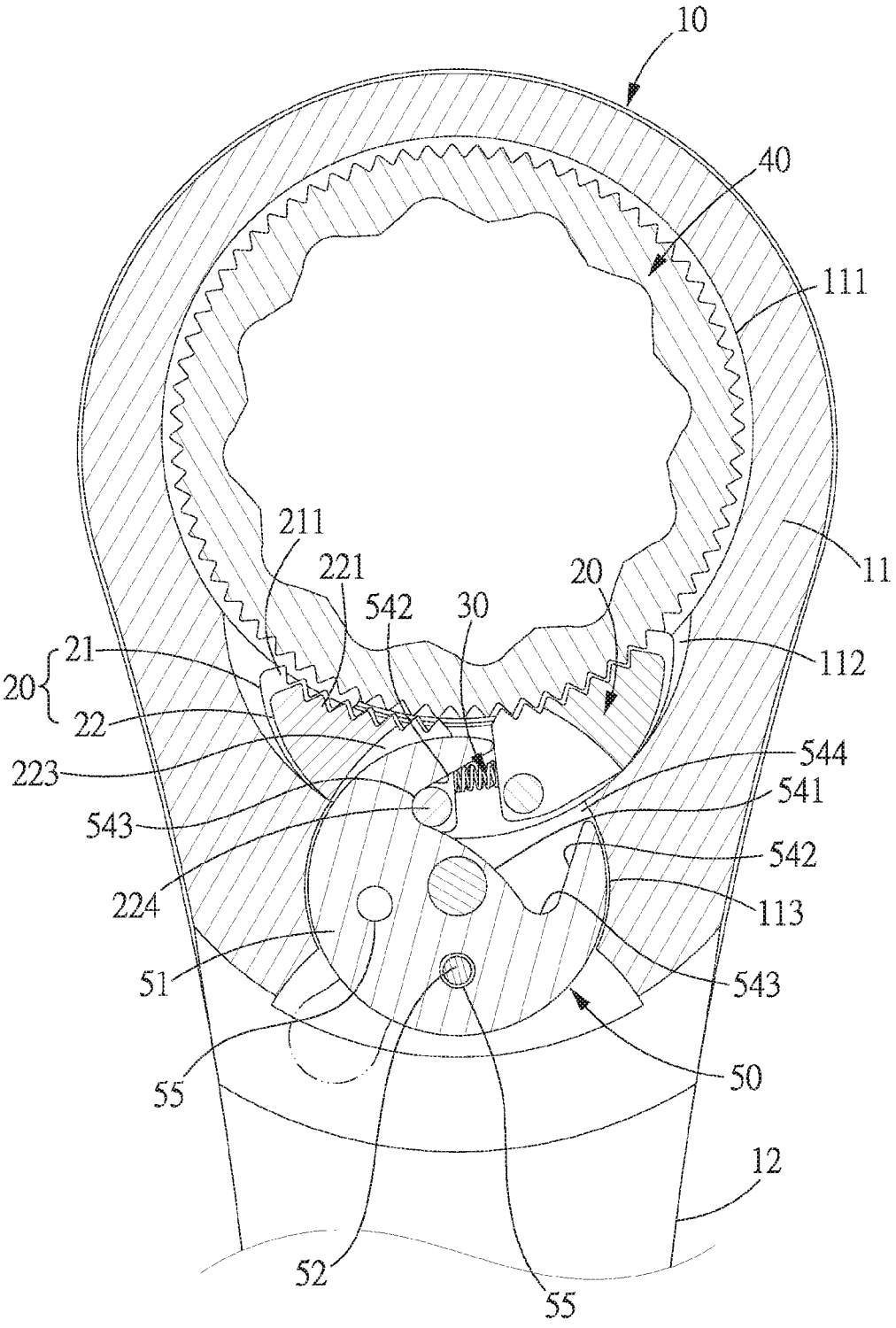
FIG. 3 is a cross sectional view of the ratchet tool with stacked switching device in accordance with the preferred embodiment of the present invention.
Figure 4:
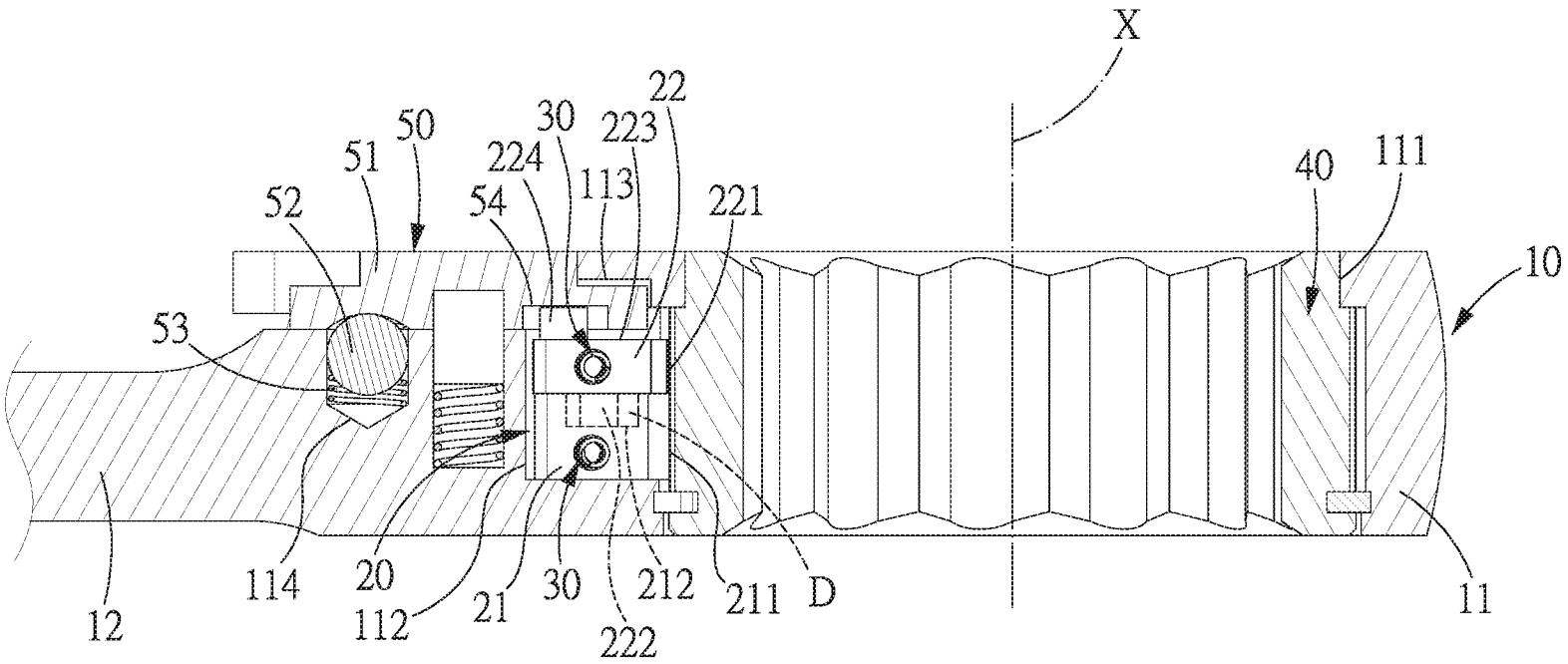
FIG. 4 is another cross sectional view of the ratchet tool with stacked switching device in accordance with the preferred embodiment of the present invention.
Figure 5:
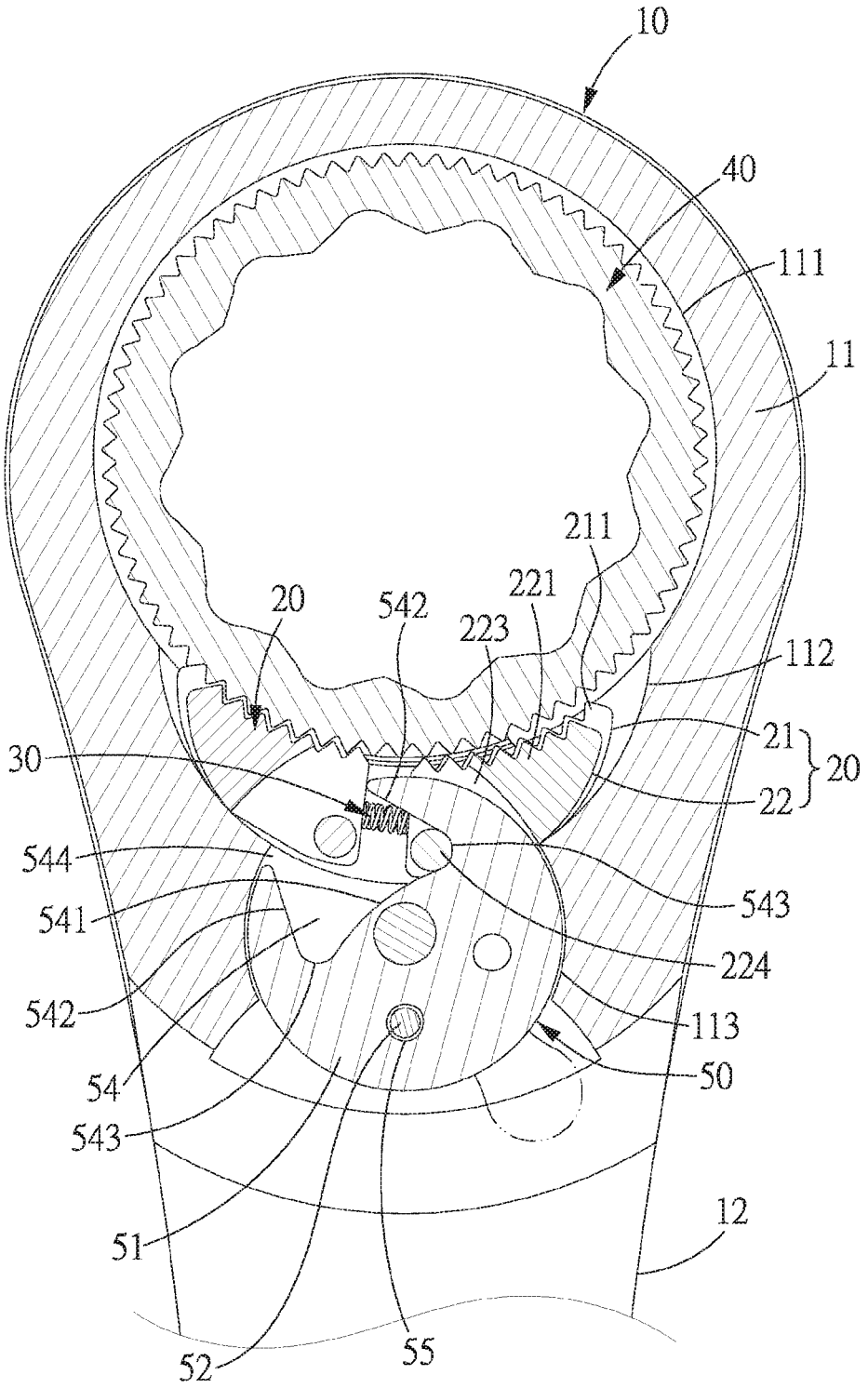
FIG. 5 is another operational view of the ratchet tool with stacked switching device in accordance with the preferred embodiment of the present invention.

Referring to FIGS. 1-5, a ratchet tool with stacked switching device in accordance with the preferred embodiment of the present invention comprises: a handle 10, two stacked engaging assemblies 20, two springs 30, a toothed wheel 40, and a control unit 50.

The handle 10 includes a head portion 11 and a handle portion 12 extending from the head portion 11. The head portion 11 is formed with a working hole 111 which penetrates the head portion 11 and extends in an axial direction X. The head portion 11 is further provided with a device cavity 112 which communicates with the working hole 111 and is closed in the axial direction X. A lateral cavity 113 is formed in the head portion 11 and communicates with the device cavity 112, and beside the lateral cavity 113 is formed a receiving cavity 114 which extends in the axial direction X.

Each of the two stacked engaging assemblies 20 includes a first engaging member 21 and a second engaging member 22. The first and second engaging members 21, 22 each include an engaging portion 211, 221 at one side thereof The engaging portions 211, 221 each include a plurality of teeth with a pitch. One surface of the first engaging member 21 is provided with a driven portion 212, one surface of the second engaging member 22 is provided with an inserting portion 222, and another surface of the second engaging member 22 is provided with a concave portion 223 and a drive portion 224 on the concave portion 223. The inserting portion 222 of the second engaging member 22 fits in the driven portion 212 of the first engaging member 21 in a concave and convex manner. A clearance D is left between the driven portion 212 and the inserting portion 222 and larger than one second of a pitch of the teeth. The first and second engaging members 22 are stacked upon each other, and the inserting portion 222 fits in the driven portion 212. When the first and second engaging members 21, 22 of each of the engaging assemblies 20 are stacked, the engaging portions 211, 221 are staggered by a half of the pitch. In this embodiment, the driven portion 212 is a circular cavity, the inserting portion 222 is a circular protrusion to be inserted in the driven portion 212. The two stacked engaging assemblies 20 are disposed at two ends of the device cavity 112.

The two springs 30 are disposed between the two stacked engaging assemblies 20, and more specifically, disposed between the two first engaging members 21, and between the two second engaging members 22, respectively.

The toothed wheel 40 is rotatably disposed in the working hole 111, and provided with a plurality of teeth to engage with the engaging portions 211, 221 of the first or second engaging member 21, 22.

The control unit 50 includes a switch member 51, a positioning member 52 and an elastic member 53. One surface of the switch member 51 is formed with a control cavity 54 and two positioning cavities 55. The control cavity 54 is U-shaped and defined by a terminal surface 541 and two lateral surfaces 542 which each have one end connected to two ends of the terminal surface 541, and a positioning angle 543 is defined at each of the connections between the lateral surfaces 542 and the terminal surface 541. The control cavity 54 has an engaging mouth 544 formed between another ends of the two lateral surfaces 542, and the distance between another ends of the two lateral surfaces 542 is smaller than the length of the terminal surface 541. The elastic member 53 and the positioning member 552 are disposed in the receiving cavity 114 of the handle 10, and the switch member 51 is rotatably disposed on the handle 10 and partially inserts in the lateral cavity 113. The engaging mouth 544 of the control cavity 54 is located toward the two stacked engaging assemblies 20, the drive portions 224 are disposed in the control cavity 54, and the two positioning cavities 55 are aligned with the receiving cavities 114.

What mentioned are the structural relations of the main components of the ratchet tool with stacked switching device in accordance with the preferred embodiment of the present invention, the operation of the present invention is the same as the operation of a conventional two-way ratchet wrench, changing engagement of the toothed wheel 40 with one of the two engaging assemblies 20 can change the drive direction or idle rotation direction of the toothed wheel 40.

After assembly, the elastic member 53 of the control unit 50 presses against the positioning member 52 to push the positioning member 52 into one of the positioning cavities 55 of the switch member 51, so as to maintain the switch member 51 in a stable state or position. In this state, the drive portion 224 of the first or second engaging members 21, 22 of one of the two stacked engaging assemblies 20 is positioned in one of the positioning angles 543 of the control cavity 54, the positioning angles 543 are located at each of the connections between the lateral surfaces 542 and the terminal surface 541, and the distance between another ends of the two lateral surfaces 542 is smaller than the length of the terminal surface 541. Therefore, during the course that the switch member 51 uses the engaging mouth 544 and gradually pivots until the drive portion 224 is positioned in one of the positioning angles 543 of the control cavity 54, the switch member 51 will push the drive portion 224 to cause the movement of the second engaging member 22. Meanwhile, the movement of the second engaging member 22 causes the first engaging member 21 to move via the cooperation of the inserting portion 222 and the driven portion 212, and as a result, the engaging assembly 20 with the drive portion 224 positioned in the positioning angle 543 is disengaged from the toothed wheel 40, while the other engaging assembly 20 is engaged in the toothed wheel 40.

To change the drive direction or idle rotation direction, the user can pivot the switch member 51 to make the drive portion 224 move from the positioning angle 543 and into another positioning angle 543, so that another one of the engaging assemblies 20 is switched to engage with the toothed wheel 40.

When in use, the toothed wheel 40 only engages with one of the engaging assemblies 20, and since the engaging portions 211, 221 of the first and second engaging members 21, 22 of the engaging assemblies 20 are staggered, the toothed wheel 40 only engages with one of the first and second engaging members 21, 22 of the engaging assembly 20 which engages with the toothed wheel 40. When the handle of the ratchet tool rotates in a non-working direction, since the engaging portions 211, 221 of the first and second engaging members 21, 22 of the engaging assemblies 20 are staggered by a half pitch, the toothed wheel 40 will reach its engagement state again by rotating less than one pitch angle, which allows the ratchet tool to be repeatedly rotated in a smaller space.

To achieve the above objective, the present invention is provided with the first and second engaging members 21, 22 which are arranged in a stacked manner. To ensure that the two engaging assemblies 20 move synchronously when changing the rotation direction of the ratchet wheel, between the first and second engaging members 21, 22 are provided the driven portion 212 and the inserting portion 222. However, the driven portion 212 and the inserting portion 222 are not limited to the above embodiment, and can be in any forms as long as they can make the driven portion 212 and the inserting portion 222 to move in a synchronous manner. For example, the driven portion 212 can be a circular protrusion, and the inserting portion 222 is a circular cavity.

To summarize, the ratchet tool with stacked switching device in accordance with the present invention enables the toothed wheel 40 to selectively engage with one of the two engaging assemblies 20, each of the engaging assemblies 20 includes the stacked first and second engaging members 21, 22, and the engaging portions 211, 221 of the first and second engaging members 21, 22 are staggered. Since the toothed wheel 40 can be selectively engaged with the engaging portions 211, 221 of the first and second engaging members 21, 22, which means that the number of teeth of the toothed wheel 40 to be engaged with the two engaging assemblies 20 is the sum of the number of teeth of the engaging portions 211, 221 of the first and second engaging members 21, 22, thus enhancing the fineness of the rotation of the toothed wheel 40, and improving the easiness and applicability of the ratchet tool, without impacting the structural strength.

While we have shown and described various embodiments in accordance with the present invention, it is clear to those skilled in the art that further embodiments may be made without departing from the scope of the present invention.

What is claimed is:

1. A ratchet tool with stacked switching device, comprising:

a handle with a head portion and a handle portion extending from the head portion, the head portion including a working hole, a device cavity which communicates with the working hole, and a lateral cavity which communicates with the device cavity;

two stacked engaging assemblies each including a first engaging member and a second engaging member, the first and second engaging members each including an engaging portion at one side thereof, the engaging portions each including a plurality of teeth with a pitch, one surface of the first engaging member being provided with a driven portion, one surface of the second engaging member being provided with an inserting portion, another surface of the second engaging member being provided with a drive portion, wherein the first and second engaging members are stacked upon each other, the inserting portion fits in the driven portion, the engaging portions are staggered by a half of the pitch, the two stacked engaging assemblies are disposed at two ends of the device cavity;

two springs disposed between the two stacked engaging assemblies, and located between the two first engaging members, and between the two second engaging members, respectively;

a toothed wheel rotatably disposed in the working hole to selectively engage with the engaging portions of the first or second engaging member; and a switch member including a control cavity formed on one surface thereof, the control cavity being defined by a terminal surface and two lateral surfaces which each have one end connected to two ends of the terminal surface, a positioning angle being defined at each of the connections between the lateral surfaces and the terminal surface, the control cavity including an engaging mouth formed between another ends of the two lateral surfaces, wherein a distance between another ends of the two lateral surfaces is smaller than a length of the terminal surface, the switch member is rotatably disposed on the handle and partially inserts in the lateral cavity, the engaging mouth of the control cavity is located toward the two stacked engaging assemblies, and the drive portion is disposed in the control cavity.

2. The ratchet tool as claimed in claim 1, wherein the inserting portion of the second engaging member fits in the driven portion of the first engaging member in a concave and convex manner, a clearance is left between the driven portion and the inserting portion, and the clearance is larger than one second of the pitch.

3. The ratchet tool as claimed in claim 1, wherein the handle includes a receiving cavity formed beside the lateral cavity, an elastic member and a positioning member are disposed in the receiving cavity of the handle, the one surface of the switch member is further formed with two positioning cavities, and rotating the switch member can make the two positioning cavities aligned with the receiving cavities.

4. The ratchet tool as claimed in claim 1, wherein another surface of the second engaging member is provided with a concave portion, and the drive portion is provided on the concave portion.

5. A ratchet tool with stacked switching device, comprising:

a handle with a head portion and a handle portion extending from the head portion, the head portion including a working hole, a device cavity which communicates with the working hole, and a lateral cavity which communicates with the device cavity;

two stacked engaging assemblies each including a first engaging member and a second engaging member, the first and second engaging members each including an engaging portion at one side thereof, the engaging portions each including a plurality of teeth with a pitch, one surface of the first engaging member being provided with a driven portion, one surface of the second engaging member being provided with an inserting portion, another surface of the second engaging member being provided with a drive portion, wherein the driven portion is a circular cavity, the inserting portion is a circular protrusion, the first and second engaging members are stacked upon each other, the inserting portion fits in the driven portion, the engaging portions are staggered by a half of the pitch, the two stacked engaging assemblies are disposed at two ends of the device cavity;

two springs disposed between the two stacked engaging assemblies, and located between the two first engaging members, and between the two second engaging members, respectively;

a toothed wheel rotatably disposed in the working hole to selectively engage with the engaging portions of the first or second engaging member; and a switch member including a control cavity formed on one surface thereof, the control cavity being defined by a terminal surface and two lateral surfaces which each have one end connected to two ends of the terminal surface, a positioning angle being defined at each of the connections between the lateral surfaces and the terminal surface, the control cavity including an engaging mouth formed between another ends of the two lateral surfaces, wherein a distance between another ends of the two lateral surfaces is smaller than a length of the terminal surface, the switch member is rotatably disposed on the handle and partially inserts in the lateral cavity, the engaging mouth of the control cavity is located toward the two stacked engaging assemblies, and the drive portion is disposed in the control cavity.

6. The ratchet tool as claimed in claim 5, wherein the handle includes a receiving cavity formed beside the lateral cavity, an elastic member and a positioning member are disposed in the receiving cavity of the handle, the one surface of the switch member is further formed with two positioning cavities, and rotating the switch member can make the two positioning cavities aligned with the receiving cavities.

7. The ratchet tool as claimed in claim 5, wherein another surface of the second engaging member is provided with a concave portion, and the drive portion is provided on the concave portion.

8. A ratchet tool with stacked switching device, comprising:

a handle with a head portion and a handle portion extending from the head portion, the head portion including a working hole, a device cavity which communicates with the working hole, and a lateral cavity which communicates with the device cavity;

two stacked engaging assemblies each including a first engaging member and a second engaging member, the first and second engaging members each including an engaging portion at one side thereof, the engaging portions each including a plurality of teeth with a pitch, one surface of the first engaging member being provided with a driven portion, one surface of the second engaging member being provided with an inserting portion, another surface of the second engaging member being provided with a drive portion, wherein the driven portion is a circular protrusion, the inserting portion is a circular cavity, the first and second engaging members are stacked upon each other, the inserting portion fits in the driven portion, the engaging portions are staggered by a half of the pitch, the two stacked engaging assemblies are disposed at two ends of the device cavity;

two springs disposed between the two stacked engaging assemblies, and located between the two first engaging members, and between the two second engaging members, respectively;

a toothed wheel rotatably disposed in the working hole to selectively engage with the engaging portions of the first or second engaging member; and a switch member including a control cavity formed on one surface thereof, the control cavity being defined by a terminal surface and two lateral surfaces which each have one end connected to two ends of the terminal surface, a positioning angle being defined at each of the connections between the lateral surfaces and the terminal surface, the control cavity including an engaging mouth formed between another ends of the two lateral surfaces, wherein a distance between another ends of the two lateral surfaces is smaller than a length of the terminal surface, the switch member is rotatably disposed on the handle and partially inserts in the lateral cavity, the engaging mouth of the control cavity is located toward the two stacked engaging assemblies, and the drive portion is disposed in the control cavity.

9. The ratchet tool as claimed in claim 8, wherein the handle includes a receiving cavity formed beside the lateral cavity, an elastic member and a positioning member are disposed in the receiving cavity of the handle, the one surface of the switch member is further formed with two positioning cavities, and rotating the switch member can make the two positioning cavities aligned with the receiving cavities.

10. The ratchet tool as claimed in claim 8, wherein another surface of the second engaging member is provided with a concave portion, and the drive portion is provided on the concave portion.

* * * * *